US010933422B2

(12) United States Patent
Stroitelev

(10) Patent No.: US 10,933,422 B2
(45) Date of Patent: Mar. 2, 2021

(54) ROLLER GRAIN MILL

(71) Applicant: ECOMILL, LLC, Aurora, CO (US)

(72) Inventor: Roman Stroitelev, Barnaul (RU)

(73) Assignee: ECOMILL, LLC, Aurora, CO (US)

( * ) Notice: Subject to any disclaimer, the term of this patent is extended or adjusted under 35 U.S.C. 154(b) by 220 days.

(21) Appl. No.: 16/011,989

(22) Filed: Jun. 19, 2018

(65) Prior Publication Data

US 2019/0381509 A1 Dec. 19, 2019

(51) Int. Cl.

| | |
|---|---|
| ***B02C 4/06*** | (2006.01) |
| ***B02C 4/38*** | (2006.01) |
| ***B02C 9/04*** | (2006.01) |
| ***B02C 23/38*** | (2006.01) |
| *B02B 5/02* | (2006.01) |

(52) U.S. Cl.

CPC ..... *B02C 4/06* (2013.01); *B02C 4/38* (2013.01); *B02C 9/04* (2013.01); *B02C 23/38* (2013.01); *B02B 5/02* (2013.01)

(58) Field of Classification Search

CPC .... B02C 4/38; B02C 4/28; B02C 4/42; B02C 4/04; B02C 4/08; B02C 23/38

USPC ..... 241/285.1, 152.1–152.2, 157–159

See application file for complete search history.

(56) References Cited

U.S. PATENT DOCUMENTS 344,258 A * 6/1886 Dunne ..... B30B 15/04 241/285.1
1,743,911 A * 1/1930 Borton ..... B02C 4/28 241/285.2
2,994,485 A * 8/1961 Elwick ..... B02C 4/30 241/102
3,899,965 A * 8/1975 Koch ..... B30B 15/04 100/155 R
4,101,083 A 7/1978 Faist
4,225,093 A * 9/1980 Rusch ..... B02C 4/06 241/159
5,351,899 A * 10/1994 Koenig ..... B02C 19/22 241/260.1
5,823,452 A * 10/1998 Ballew ..... B02C 4/06 241/225
6,015,107 A * 1/2000 Stegmeier ..... B02C 4/02 241/101.2
6,149,085 A * 11/2000 Fetzer ..... B02C 4/28 241/227

(Continued)

FOREIGN PATENT DOCUMENTS

WO 2007/013832 2/2007

*Primary Examiner* — Faye Francis
(74) *Attorney, Agent, or Firm* — Tyler S. Dunham

(57) ABSTRACT

The exemplary embodiments herein provide a roller grain mill assembly having a lower frame, a plurality of roller grain mills attached to the lower frame, an upper frame extending upwardly from the lower frame, a single electric drive mechanically coupled to each of the roller grain mills, and a cyclone separator placed in gaseous communication with the roller grain mills and located above the electric drive. In some embodiments, a centrifugal scatterer may be suspended from the upper frame and placed in gaseous communication with the roller grain mill. In other embodiments, a cyclone separator may be placed in gaseous communication with the roller grain mill and centrifugal scatterer. An electric drive coupled to each roller grain mill may be cantilevered off the lower frame.

15 Claims, 4 Drawing Sheets

(56) References Cited

U.S. PATENT DOCUMENTS

| | | | | |
|---|---|---|---|---|
| 9,289,959 | B2 * | 3/2016 | Frangenberg | B30B 15/04 |
| 10,065,192 | B2 * | 9/2018 | Frangenberg | B02C 4/28 |
| 10,307,764 | B2 * | 6/2019 | Petack | B02C 4/30 |
| 2003/0145738 | A1 * | 8/2003 | Bowen | B02C 4/286<br>99/353 |
| 2009/0294558 | A1 * | 12/2009 | Bihn | B02C 4/08<br>241/6 |
| 2010/0186607 | A1 * | 7/2010 | Horster | B02C 4/02<br>100/176 |
| 2010/0219278 | A1 * | 9/2010 | Hagedorn | B02C 4/02<br>241/278.1 |
| 2013/0025476 | A1 * | 1/2013 | Frangenberg | B02C 4/02<br>100/155 R |
| 2019/0176159 | A1 * | 6/2019 | Hoehn | B02C 4/02 |

* cited by examiner

ROLLER GRAIN MILL

CROSS-REFERENCE TO RELATED APPLICATIONS

This application does not claim priority to any co-pending applications.

TECHNICAL FIELD

Embodiments generally relate to devices for the processing of agricultural products, specifically the milling of grains into flour.

BACKGROUND OF THE ART

The milling of grains has traditionally been done with very large and complicated equipment. This results in fewer grain mills being available for use, due to their start-up costs and complexity. With only a few large mills available, resulting product must be shipped for long distances before reaching the customer, resulting in higher shipping costs. Further, locally-grown grains may not be usable by local bakeries, restaurants, and breweries because no grain mill is available locally to mill the grain. Previous roller grain mill designs used the available space very inefficiently, resulting in very large and complex machines, especially if you desire very fine white flour.

SUMMARY OF THE EXEMPLARY EMBODIMENTS

Exemplary embodiments provide an upper frame connected to a lower frame, where the lower frame contains a plurality of roller milling machines connected to a single electric drive where the electric drive is cantilever mounted so that at least a portion of the electric drive extends outside of the boundary of the upper frame. Centrifugal scatterers are connected with product pipelines to each roller milling machine in order to remove partial fractures, waste, and other debris which can be removed through a vacuum and drawn through one or more cyclone separators. Preferably, the top frame defines a cube or rectangular/quadrangular prism and the cyclone separators are placed outside of the rectangular/quadrangular prism. Each centrifugal scatterer should be placed above the corresponding roller mill machine and may be suspended by the upper frame. The roller milling machines are preferably mounted to the lower frame and are wider than the top frame (i.e. extend past the vertical legs).

This design has been shown to improve the efficiency of the rolling grain mill by placing components in the best orientation to reduce overall space used, footprint required, and the amount of distance that the product must travel in order to be fully processed. Overall vibrations of the machine have been reduced while the individual components remain easily accessible for maintenance or replacement. The resulting assembly is much easier to ship and can be installed in tighter, less-accessible areas.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
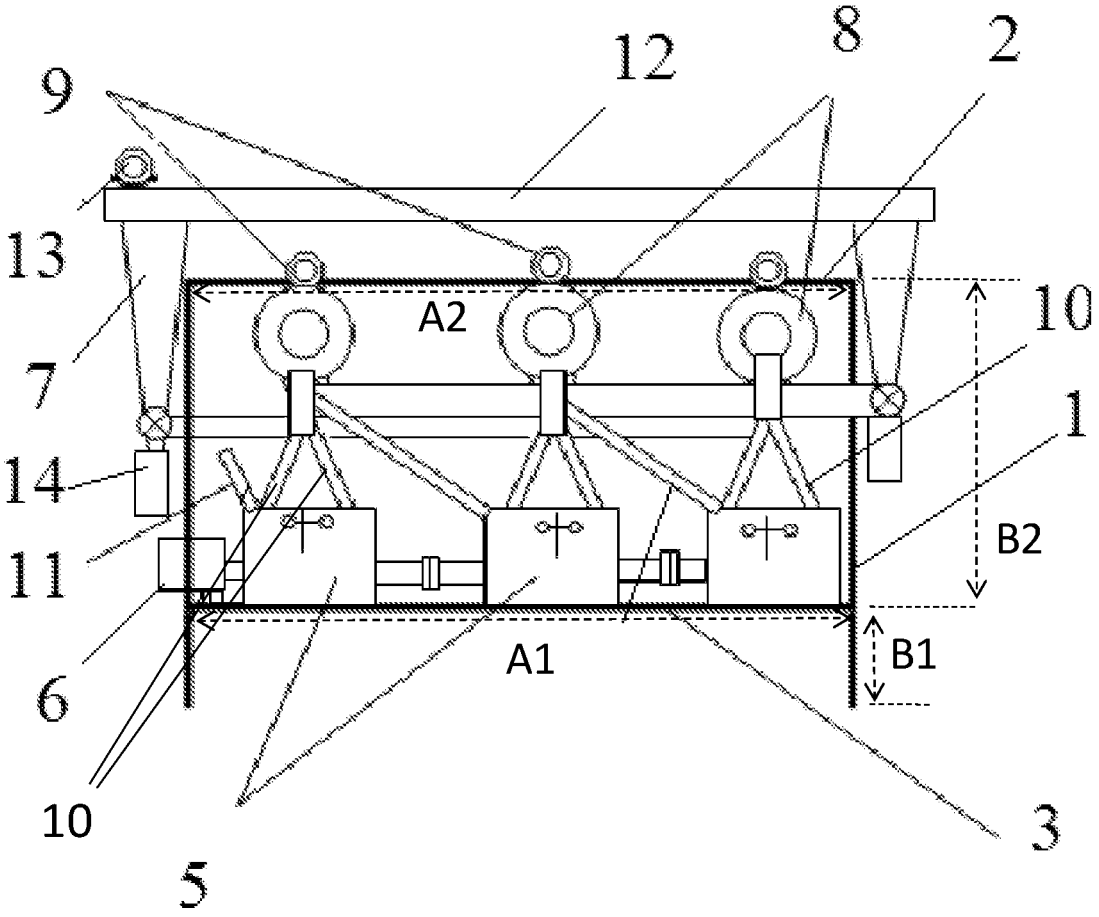
FIG. 1 is a simplified front elevation view of an exemplary embodiment of the roller grain mill.

FIG. 1 is a simplified side elevation view of an exemplary embodiment of the roller grain mill. A frame 1 is constructed of an upper frame 2 attached to the top portion of a lower frame 3, where each generally take the form of a quadrangular prism. The upper frame 2 and lower frame 3 each contain a set of four vertical legs, as shown here the vertical legs of the lower frame 3 are shown as legs B1 while the vertical legs of the upper frame 2 are shown as legs B2. As shown, generally B1 is less than half the length of B2. Preferably, the length of legs B2 is between 2× and 6× the length of legs B1. The upper frame 2 contains a pair of opposing horizontal side portions A2 while the lower frame 3 contains a pair of opposing horizontal side portions A1, where all four portions are preferably about the same length. Generally, it is preferable that A1/A2 is as long or longer than both legs B1 and B2 combined.

Several roller milling machines 5 are mounted to the opposing horizontal side portions A1 of the lower frame 3. A single electric drive or motor 6 is placed so that at least a portion of the electric drive 6 extends outside the lower frame 3, past the vertical legs B1, while also being placed in mechanical connection with each of the roller milling machines 5. The electric drives or motors 9 are also in mechanical connection with each centrifugal scatterers 8.

Either the electric drives 9 or the centrifugal scatterers 8 can be mounted to the side horizontal portions A2 of the upper frame 2.

The grain is initially inserted into a pneumatic separator 20 (shown in FIG. 3) which feeds a product inlet self-sink 11 into the first roller milling machine 5. Ambient air is also ingested into the roller milling machine 5 by the fan 13, in order to create a vacuum for removing airborne particulate, partial fractures, and other small debris.

The product pipeline 10 then preferably carries the result from the first roller milling machine 5 to a centrifugal scatterer 8 which removes fine fractures through the product pipeline 15, which provides communication with a cyclone separator 7. A fan 13 is positioned to create a vacuum through the waste pipeline 12 and cyclone separators 7. The electric drives 9 for each of the centrifugal scatterers 8 are preferably placed just above the centrifugal scatterer 8 being driven. Either the electric drives 9 or the centrifugal scatterers 8 can be attached to the side horizontal portions A2 of the upper frame 2, or may be located underneath the side horizontal portion A2 of the upper frame 2. Preferably, the cyclone separators 7 are placed outside the vertical portions B2 of the upper frame 2. It is also preferable that no cyclone separator 7 is placed alongside or adjacent to the horizontal portion A2. Also, preferably the electric drive 6 extends outside of the lower frame 3 and upper frame 2 on the same side of the frame 1 where a cyclone separator 7 is placed. A collector 14 is preferably connected to a cyclone separator 7 in order to collect any partial fractures or waste.

The product then travels through a second roller milling machine 5, and again to a centrifugal scatterer 8 which separates partial fractures and removes large fractures through the self-sink 11 into the third roller milling machine 5, which removes fine fractures through the product pipeline 15 which provides gaseous communication with a cyclone separator 7. In this embodiment, the product then travels through a third roller milling machine 5, and again to a centrifugal scatterer 8 which separates partial fractures and waste and removes this through the waste pipeline 12, which provides gaseous communication with a cyclone separator 7. From here, the grinded grain product can be extracted if desired, or directed into further parings of roller milling machines 5 and centrifugal scatterers 8 until the desired quality of flour has been obtained. In other words, additional pairs of roller milling machines 5 and centrifugal scatterers 8 may be used in other embodiments, depending on the application and how fine the flour is to be produced by the mill.

Figure 2:
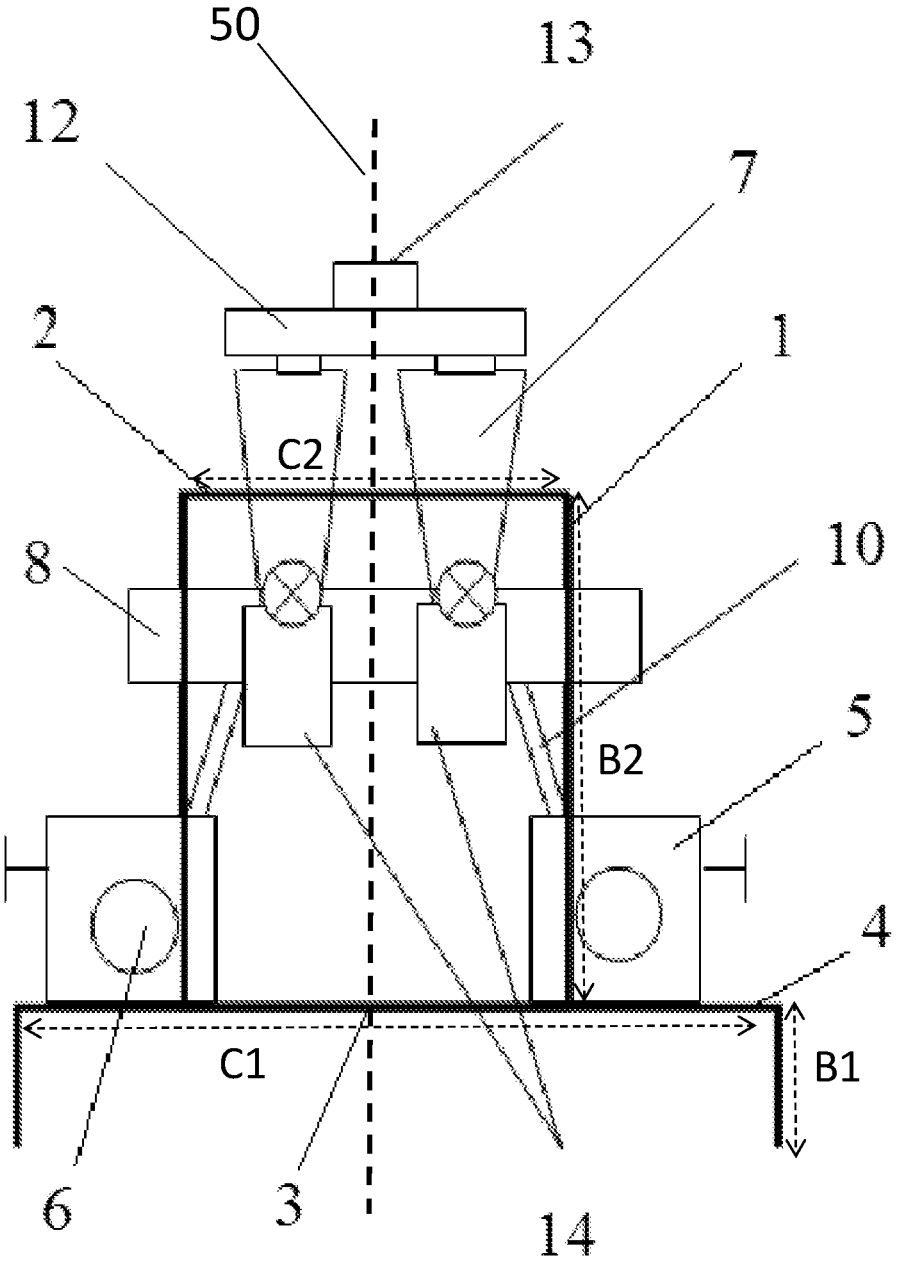
FIG. 2 is a simplified side elevation view of the embodiment of the roller grain mill shown in FIG. 1.

FIG. 2 is a simplified front elevation view of the embodiment of the roller grain mill shown in FIG. 1. Here we can see the front horizontal portions of the frame 1, where the opposing front horizontal portions C1 of the lower frame 3 are perpendicular to the legs B1. The opposing front horizontal portions C2 of the upper frame 2 are generally perpendicular to the legs B2. Preferably, C1 is larger than C2. Generally, an exemplary embodiment would have portions C1 being approximately twice the length of portions C2. The front horizontal portions C1 of the lower frame 3 extend away from the upper frame 2 with the arms 4, so that the lower frame 3 has a larger footprint than the upper frame 2. Preferably, the roller milling machines 5 would extend past the vertical portions B2 of the upper frame 2 and along at least a portion of the arms 4. In other words, the roller milling machines 5 are generally longer than the horizontal portions C2, and would generally have the roller milling machines 5 centered beneath the portions C2 such that they substantially share a vertical centerline 50.

Although above it was mentioned that the cyclone separators 7 should be outside of the vertical legs B2, this was only with respect to the two vertical legs B2 which define the horizontal portions A2. As shown here, with respect to the two vertical legs B2 which define the horizontal portions C2, the cyclone separators 7 are placed inside of the vertical legs B2. In other words, the cyclone separators 7 are preferably placed adjacent to or alongside the horizontal portions C2 but not along horizontal portions A2. Generally, the cyclone separators 7 should be outside of the quadrangular prism created by the upper frame 2. The centrifugal scatterers 8 should mostly be located within the cube or prism defined by the upper frame 2, however as shown, portions of the scatterers 8 may extend past the vertical legs B2, similar to that of the roller milling machines 5.

Figure 3:
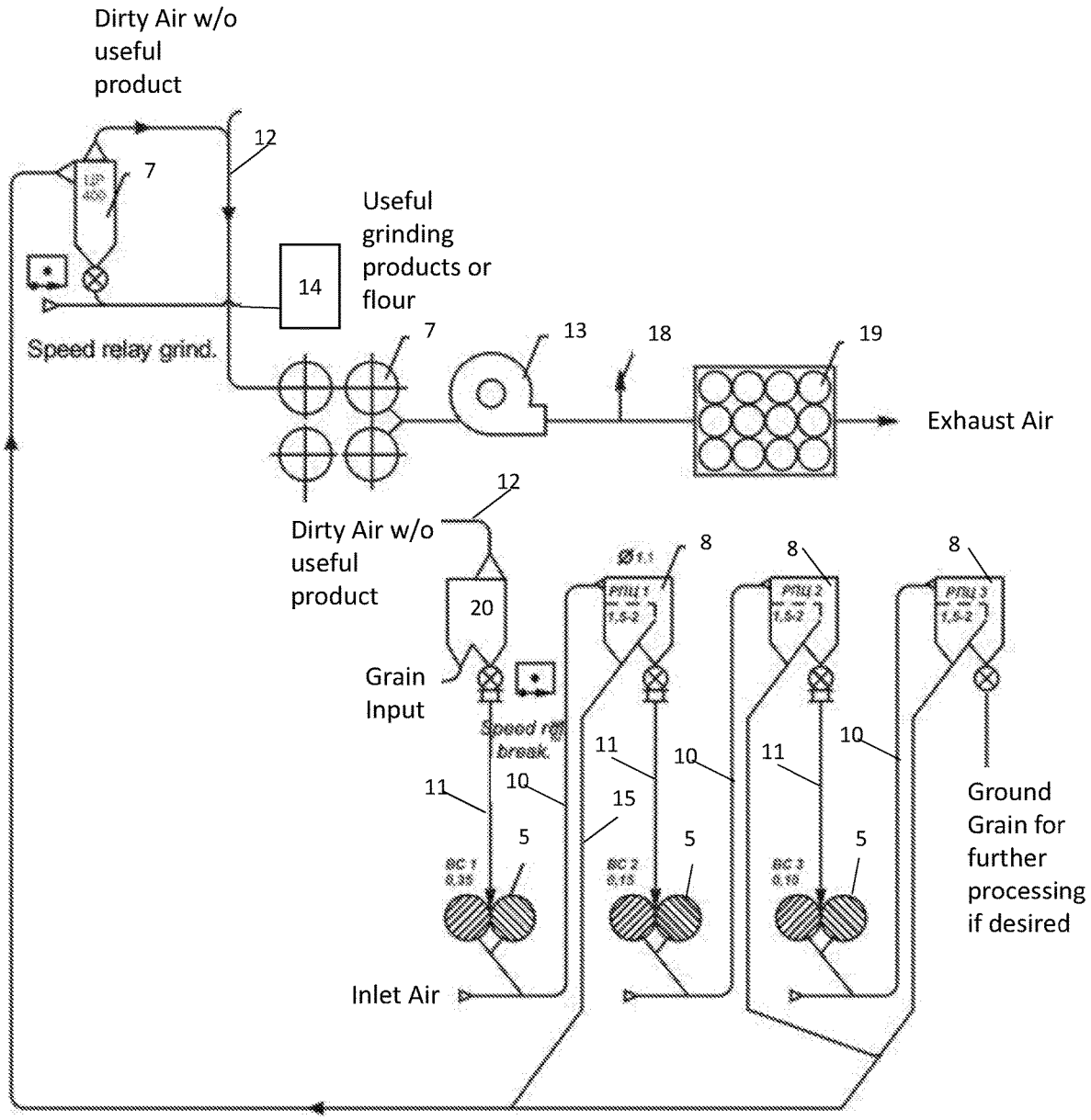
FIG. 3 is a schematic illustration of the flow of air and product through an exemplary roller grain mill.

FIG. 3 is a schematic illustration of the flow of air and product through an exemplary roller grain mill. The fan 13 is preferably placed above the horizontal portions of the upper frame 2, in gaseous communication with each roller milling machine 5, centrifugal scatterer 8, and cyclone separator 7 through the waste pipelines 12. Any air and small particulate that escapes the cyclone separator 7 may travel through further cyclone separators 7, before reaching the fan 13, explosion suppression assembly 18, and filter 19 before being exhausted.

Figure 4:
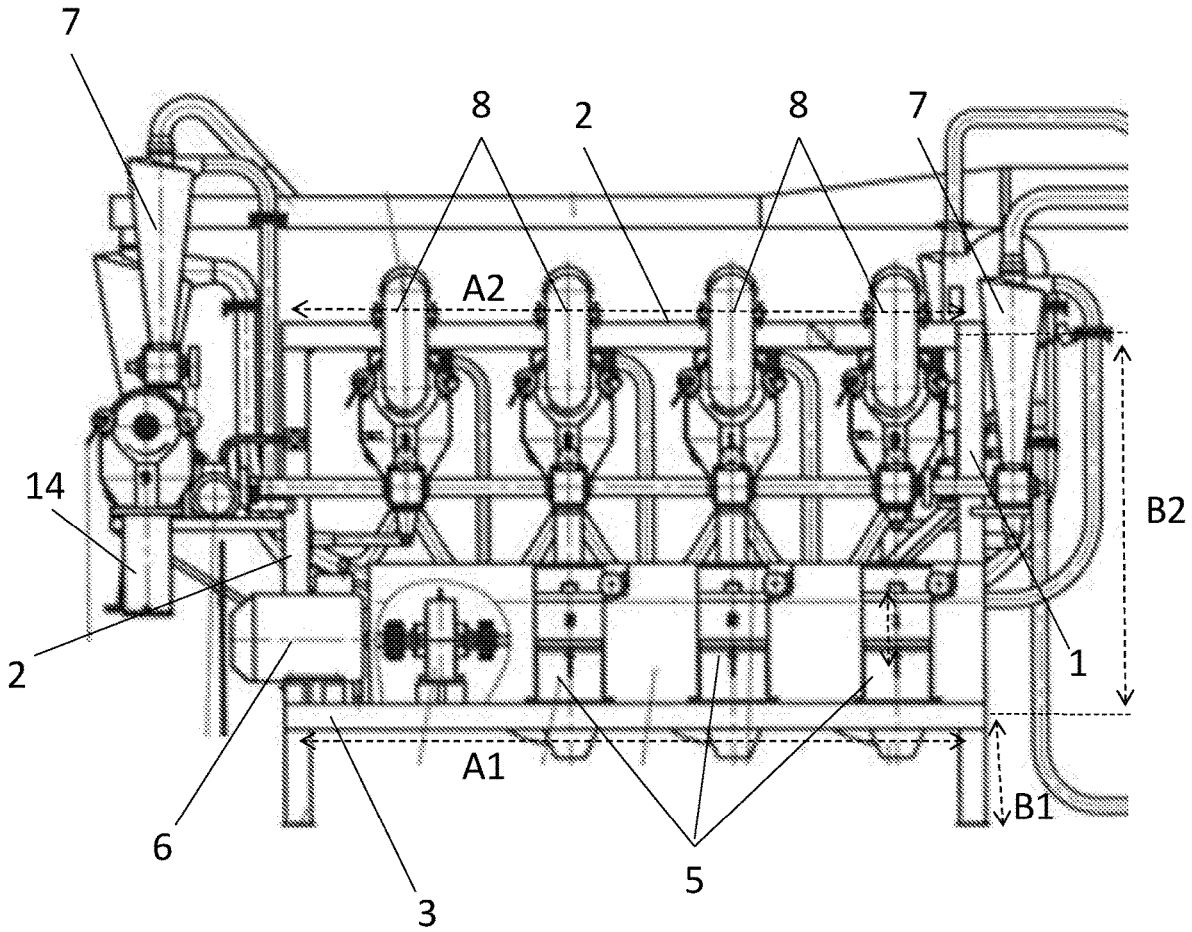
FIG. 4 is a side elevation view of another embodiment of the roller grain mill.

FIG. 4 is a side elevation view of another embodiment of the roller grain mill. Again, preferably a single electric drive or motor 6 is placed so that at least a portion of the electric drive 6 extends outside the lower frame 3 (cantilevered), past the vertical legs B1, while also being placed in mechanical connection with each of the roller milling machines 5. Similar to the above embodiment, the centrifugal scatterers 8 can be attached to the side horizontal portions A2 of the upper frame 2, or may be located underneath the side horizontal portion A2 of the upper frame 2. Preferably, the cyclone separators 7 are placed outside the vertical portions B2 of the upper frame 2. It is also preferable that no cyclone separator 7 is placed alongside or adjacent to the horizontal portion A2. Also, preferably the electric drive 6 extends outside of the lower frame 3 and upper frame 2 on the same side of the frame 1 where a cyclone separator 7 is placed. A collector 14 is preferably connected to a cyclone separator 7 in order to collect any partial fractures or waste.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

I claim:

1. A roller grain mill assembly comprising:

a lower frame having a footprint and comprising;

a pair of opposing horizontal side portions A1, a pair of opposing horizontal front portions C1 where each horizontal front portion C1 connects with both of the horizontal side portions A1, and four vertical legs B1 which extend downwardly from the horizontal portions A1 and C1;

an upper frame having a smaller footprint than the lower frame and comprises:

a pair of opposing horizontal side portions A2, a pair of opposing horizontal front portions C2 where each horizontal front portion C2 connects with both of the horizontal side portions A2, and four vertical legs B2 which extend downwardly from the horizontal portions A2 and C2 to connect with the lower frame;

a roller grain mill attached to one of the horizontal side portions A1 of the lower frame such that the roller grain mill extends partially outside of the upper frame; and an electric drive attached to one of the horizontal front portions portion C1 and mechanically coupled to the roller grain mill.

2. The roller grain mill assembly of claim 1 wherein:

vertical legs B2 are at least twice as long in length as vertical legs B1.

3. The roller grain mill assembly of claim 1 wherein:

each of the opposing horizontal portions C1 and each of the opposing horizontal portions C2 are longer than each of the vertical legs B1.

4. The roller grain mill assembly of claim 1 wherein:

each of the opposing horizontal front portions C1 of the lower frame are longer than each of the opposing horizontal front portions C2 of the upper frame.

5. The roller grain mill assembly of claim 1 wherein:

each of the opposing side horizontal portions A2 are the same length as each of the opposing side horizontal portions A1.

6. The roller grain mill assembly of claim 1 further comprising:

a cyclone separator placed in gaseous communication with the roller grain mill and located above the electric drive.

7. The roller grain mill assembly of claim 6 wherein:

the cyclone separator is further placed outside the upper frame and lower frame.

8. The roller grain mill assembly of claim 6 further comprising:

a centrifugal scatterer placed in gaseous communication with the roller grain mill and the cyclone separator.

9. The roller grain mill assembly of claim 6 wherein:

the cyclone separator is positioned adjacent to one of the front horizontal portions C2 of the upper frame.

10. The roller grain mill assembly of claim 6 wherein:

the cyclone separator is positioned on the same side of the frame as the electric drive.

11. The roller grain mill assembly of claim 6 further comprising:

a fan positioned to create a vacuum through the cyclone separator.

12. The roller grain mill assembly of claim 11 wherein:

the fan is further positioned to create a vacuum through the roller grain mill.

13. The roller grain mill assembly of claim 1 wherein:

the electric drive extends outside of the lower frame.

14. The roller grain mill assembly of claim 1 further comprising:

a centrifugal scatterer positioned above the roller grain mill and suspended from one of the horizontal side portions A2.

15. The roller grain mill assembly of claim 1 wherein:

the roller grain mill extends past the vertical legs B2.

* * * * *